US009155357B2

(12) United States Patent
Chon et al.

(10) Patent No.: US 9,155,357 B2
(45) Date of Patent: Oct. 13, 2015

(54) AUTOMATED STROBEL PRINTING

(75) Inventors: Yong-Joo Chon, Busan (KR); Doo Young Kim, Busan (KR); Young Gwan Kim, Busan (KR)

(73) Assignee: NIKE, Inc., Beaverton, OR (US)

( * ) Notice: Subject to any disclaimer, the term of this patent is extended or adjusted under 35 U.S.C. 154(b) by 247 days.

(21) Appl. No.: 13/610,207

(22) Filed: Sep. 11, 2012

(65) Prior Publication Data

US 2014/0068878 A1 Mar. 13, 2014

(51) Int. Cl.

| | |
|---|---|
| ***G06F 19/00*** | (2011.01) |
| ***A43D 1/00*** | (2006.01) |
| ***A43B 13/38*** | (2006.01) |
| ***A43D 8/22*** | (2006.01) |
| ***A43D 8/26*** | (2006.01) |

(52) U.S. Cl.

CPC . *A43D 1/00* (2013.01); *A43B 13/38* (2013.01); *A43D 8/22* (2013.01); *A43D 8/26* (2013.01); *A43D 2200/50* (2013.01)

(58) Field of Classification Search

CPC ..... A43D 8/10; A43D 8/12; A43D 8/22; A43D 8/26; A43D 8/28; A43D 1/00; A43B 13/38

USPC ..... 700/130–133; 12/18.5, 142 R

See application file for complete search history.

(56) References Cited

U.S. PATENT DOCUMENTS

| | | | | |
|---|---|---|---|---|
| 5,256,029 | A | 10/1993 | Fluck | |
| 6,499,513 | B1 * | 12/2002 | Couch | 112/470.03 |
| 2008/0010867 | A1 * | 1/2008 | Davis, III | 700/131 |
| 2011/0283562 | A1 | 11/2011 | Shrum et al. | |
| 2013/0125319 | A1 | 5/2013 | Regan | |

FOREIGN PATENT DOCUMENTS

| | | |
|---|---|---|
| EP | 1125514 | 8/2001 |
| WO | 2013049800 | 4/2013 |

OTHER PUBLICATIONS

Notification of Transmittal of the International Search Report and the Written Opinion of the International Searching Authority, or the Declaration in PCT/US13/59017 mailed Feb. 7, 2014, 38 pages.

Web Site—http://dpidgprinting.com/products/210/s1-150-roto-special. Last Accessed May 13, 2015.

International Preliminary Report on Patentability dated Mar. 26, 2015 in Application No. PCT/US2013/059017, 9 pages.

* cited by examiner

*Primary Examiner* — Nathan Durham

(74) *Attorney, Agent, or Firm* — Shook, Hardy & Bacon L.L.P.

(57) ABSTRACT

A machine moves shoe strobels to a camera or scanner where images of the strobels are captured. Using the images, a computing device instructs a printer how to mark guidelines on the strobels that signify one or more strobel sewing lines for different shoes models and shoe sizes. Cross-sectional lines may also be printed on the strobels to aid in error-checking guideline marking. Unmarked strobels are stacked in a loading compartment, sometimes in pairs—e.g., right and left shoe strobels. The unmarked strobels are transferred to a conveyor that brings the strobels to the camera or scanner and the printer. After guidelines and/or cross-sectional lines are added to the strobels, the marked strobels are stacked in a compartments housing other marked strobels.

18 Claims, 7 Drawing Sheets

AUTOMATED STROBEL PRINTING

BACKGROUND

Shoe manufacture is a labor-intensive business. Shoe uppers must be cut. Joining edges and uppers must be thinned, commonly called "skiving" and "splitting." Upper pieces must be affixed with interlines. Eyelets need to be formed. Uppers must be stitched, sewn, or otherwise affixed to strobels so as to fit over particular lasts, which include specific toe shape, heel height, or other dimension. As shoe technologies continue to evolve, particularly athletic shoe designs, the number of shoe pieces being added has increased, requiring increasingly complicated manufacturing steps to produce shoes. Such manufacturing steps are still largely carried out by hand.

Automating shoe manufacturing is no trivial task. While humans can easily assemble shoes on a last and sew uppers and strobels together, such tasks are cumbersome to machines that cannot move freely. Along the same lines, checking shoe parts for errors can be easily done by workers trained to look for specific problems but is difficult for machines.

SUMMARY

This summary is provided to introduce a selection of concepts in a simplified form that are further described below in the Detailed Description. This summary is not intended to identify key features or essential features of the claimed subject matter, nor is it intended to be used as an aid in determining the scope of the claimed subject matter.

One aspect of the invention is directed to a machine that automatically prints sewing guidelines on shoe strobels. The machine mechanically moves the strobels to a camera or scanner to capture images. To get the strobels to the camera, the strobels may be picked up by a vacuum pad out of a compartment holding unmarked strobels. The vacuum pad places the unmarked strobels onto a conveyor that brings the strobes to the camera.

Images of the strobels are captured and analyzed by a computing device, and an image-recognition module identifies strobels in the image so the computing device can instruct a printer how to print the guidelines. Guidelines are then printed based on a strobel's orientation in the image. The orientation of the strobel refers to how the strobel is positioned on the conveyor—for example, slightly turned right, left, etc.

Printing may be performed by any number of printers, such as a multi-head inkjet with the multiple printer heads working in tandem. Once guidelines are printed, the conveyor moves the marked strobels away from the printer, and the strobels are transferred to an end compartment containing stacks of marked strobels. A ramp or vacuum pad may be used to remove marked strobels from the conveyor.

The guidelines printed on the strobels may include cross-sectional lines between different points. That way, error-checking can be performed by looking at how the cross-sectional lines are printed. If the lines connect the points, then guidelines are likely accurate. If not, however, the guidelines may have been printed in error.

Marking strobels with guidelines aid later stages of shoe assembly. Eventually, strobels need to be affixed—e.g., through stitching, adhesion, or the like—to shoe uppers to permit lasting and/or other assembly processes to be performed. While methods for strobel-upper affixations are beyond the scope of the present invention, the guidelines discussed herein can benefit such methods in numerous ways.

BRIEF DESCRIPTION OF THE SEVERAL VIEWS OF THE DRAWINGS

The present invention is described in detail below with reference to the attached drawing figures, wherein.

DETAILED DESCRIPTION

The subject matter described herein is presented with specificity to meet statutory requirements. The description herein, however, is not intended to limit the scope of this patent. Instead, it is contemplated that the claimed subject matter might also be embodied in other ways, to include different steps or combinations of steps similar to the ones described in this document, in conjunction with other present or future technologies. Moreover, although the term "block" may be used herein to connote different elements of methods employed, the term should not be interpreted as implying any particular order among or between various steps herein disclosed.

In general, examples described herein are directed towards automating shoe manufacturing using devices that print various guidelines on strobels. In one example, a production line is created whereby a conveyor move strobel pieces through different processing stages. In such an example, the strobels are taken from a compartment housing stacks of unfinished strobels and placed onto the conveyor. The conveyor guides each strobel to an imaging area that includes one or more cameras capable of capturing images of the strobel. By analyzing the images, a computing device can understand the position of the strobel on the conveyor, or in the imaging area, and instruct a printer about marking guidelines on the strobel. In one example, guidelines are marked based on a particular shoe model and/or shoe size. Guidelines may be checked for accuracy in some embodiments to ensure the guidelines are marked properly. The marked strobels are eventually moved from the conveyor to a compartment housing stacks of marked strobels that can be used in other phases of shoe manufacturing.

As used herein, "strobels" refer to woven or sheet material also referred to as shoe strobels that may be sewn, or otherwise affixed, to shoe uppers to permit lasting and/or other assembly processes to be performed. Examples described herein print guidelines on strobels to aid in subsequent affixation processes (e.g., adhesion, sewing, weaving, etc.). It may be advantageous in some examples of the present invention to move, photograph, and mark strobels in pairs—i.e., a left and right shoe strobel. Examples of the present invention may therefore move pairs of strobels together from initial compartment to conveyor, through the vision and printing areas, and to the finished compartment. While some examples use pre-cut strobels, alternative embodiments may alternatively use uncut material that will later be cut into strobels—for instance, after guidelines are printed.

Figure 1:
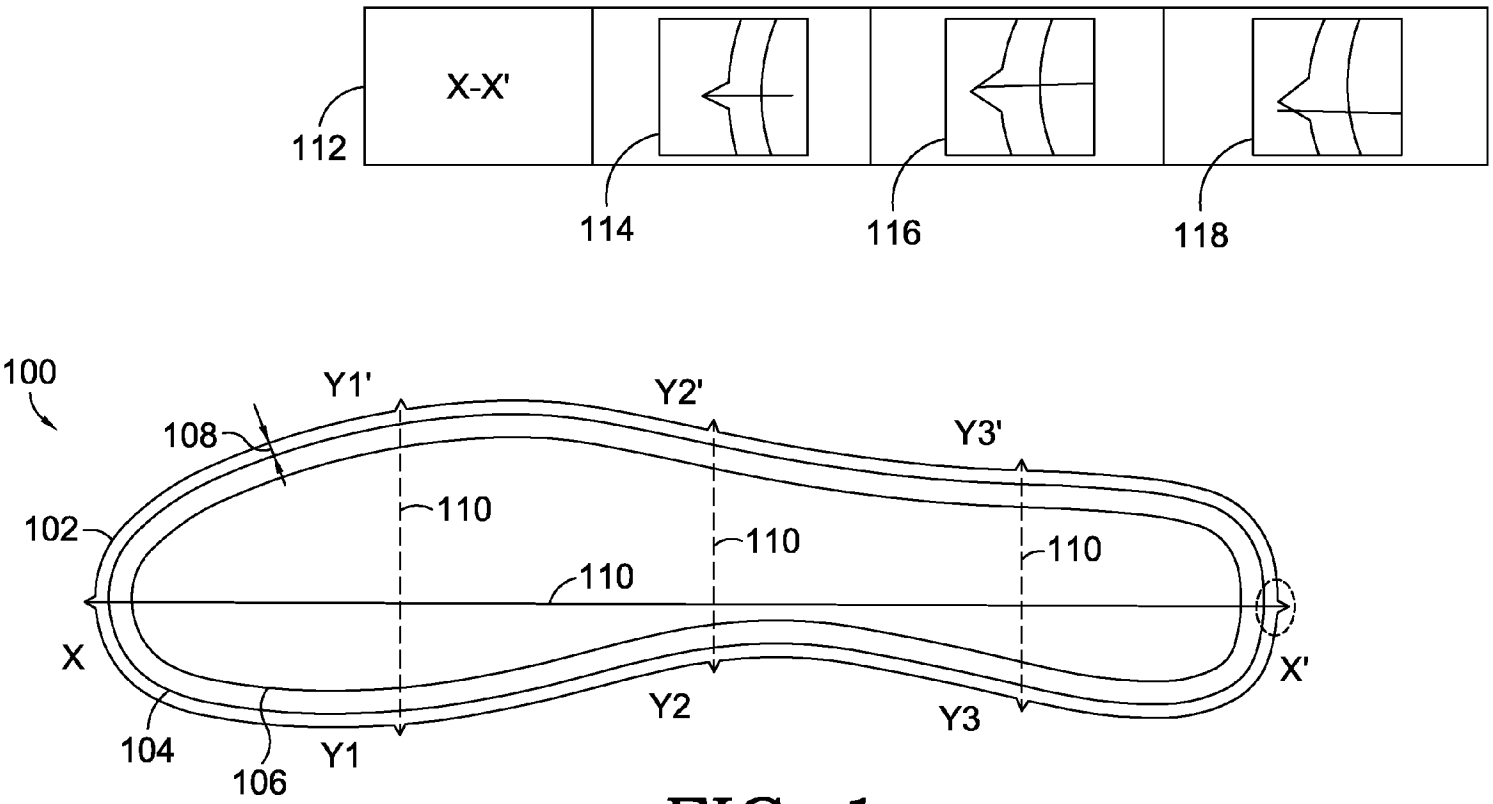
FIG. 1 is a diagram of guidelines printed on a shoe strobel, according to one example of the present invention.

As used herein, "guidelines" refer to strobel gauge lines printed on strobel material. FIG. 1 illustrates several guidelines 102, 104, and 106 printed on a shoe strobel 100 (referred to simply as "strobel 100" for clarity), according to one example. Guidelines 102, 104, and 106 outline the strobel adhesion lines—i.e., where the strobel should be attached to an upper—for three different shoe sizes. Doing so allows the same strobel to be used for different shoe sizes. Additional or fewer guidelines may alternatively be printed, such as, for example, five different shoe sizes or simply one shoe size.

In one example, guidelines 102, 104, and 106 are printed within a threshold distance 108 apart to ensure proper shoe sizes for the strobel. For example, guideline 102 may ideally be printed 0.5 mm—or some comparable distance, such as 0.35-0.65 mm—away from guideline 106 to outline different shoe sizes. While only shown at one point, threshold distance 108 may be measured or checked at various points between guidelines 102, 104, and 106 using a camera or scanner.

Guidelines 102, 104, and 106 may be printed on strobel 100 using any number of inks or marking materials. Inkjet, laser, dot-matrix, thermal, or impact printers may be used to generate guidelines 102, 104, and 106. Some shoe designs may require very precise guidelines be printed on strobels, requiring specific printers. Different printers may be more or less prone to ink spreads, line rastering, broken lines, and/or material burns, particularly when used with specific types of strobel materials. For example, a multi-head inkjet printer may be used to ensure high-quality, accurate printing of guidelines 102, 104, and 106.

Examples of the present invention are not limited to printing, however. Instead of printing guidelines 102, 104, and 106, some examples of the present invention cut or score guidelines 102, 104, and 106 into shoe strobel 100. For the sake of clarity, examples discussed below refer to guidelines being printed on shoe strobels, even though the guidelines may easily be cut or scored if the material used for the strobel is susceptible to such treatment. Yet, it should be noted that error-checking guidelines may also be performed by examples of the present invention that score or cut guidelines by comparing any of the threshold distances and cross-sectional lines mentioned herein, or also by checking the depths of cuts, scores, and incisions using captured images. For example, a cut that is only 0.005 mm may not easily be seen in other phases of shoe manufacturing, so such a cut may be considered an error.

Guidelines may also include cross-sectional lines 110. Cross-sectional lines 110 are straight lines printed between two designated points (referred to herein as a "point" and "counter point") on the outermost guideline, illustrated as guideline 102 in FIG. 1. Cross-sectional lines help gauge how accurately guidelines are printed because a cross-sectional lines starting at one point should intersect another point in a certain spot. How accurately guidelines are marked on shoe strobels may be assessed using cross-sectional lines 110. On strobel 100, eight points are shown: X, X', Y1, Y1', Y2, Y2', Y3, and Y3'. A cross-sectional line 110 is printed from one point to the point's counter (e.g., X to X', Y1 to Y1', Y2 to Y2', and Y3 to Y3'). The intersection of cross-sectional lines 110 at the points or counter points is then analyzed to tell whether guidelines 102, 104, and 106 are accurately printed on strobel 100. Because cross-sectional lines 100 are printed straight, cross-sectional lines 110 should touch the designated points and counter points in certain spots. For example, the triangular markings of points X, X', Y1, Y1', Y2, Y2', Y3, and Y3' would ideally receive the ends of cross-sectional lines 110 directly into the apex of the triangular markings—not beyond the apex or at a leg.

One example of a method in accordance with the present invention checks for errors of cross-sectional lines 110. In this example, the method may specifically determine whether a cross-sectional line 110 ends within a certain distance of the triangular apex of a point (X, Y1, Y2, or Y3) or counter point (X', Y1', Y2', or Y3'). Or, alternatively, an exemplary method may simply determine whether the cross-sectional line 110 ends somewhere within the triangular marking of a point or counter point. Images may be captured at the points and counter points and later analyzed to determine whether the cross-sectional lines 110 are within acceptable error thresholds.

Chart 112 shows one example of acceptable and unacceptable cross-sectional line 110 intersections with different points. As shown for the cross-sectional line between X and X', an input image 114 is used for comparison with whatever images are captured for at points X and X'. Input image 114 represents a cross-sectional line 110 that extends perfectly to the triangular apex of point X. Image 116 represents an actual image taken of from strobel 100 of the cross-sectional line 110 at point X, extending nearly to the triangular apex but not precisely. One example deems image 116 acceptable because cross-sectional line 110 is within an acceptable error distance of the triangular apex, resulting in the cross-sectional line 110 being deemed acceptable. On the other hand, image 116 captures a cross-sectional line 110 that does not end within the acceptable error distance, so the cross-sectional line 110 is deemed unacceptable. Similar analyses may be performed at the other points and counter points for the rest of the lines, revealing whether guidelines 102, 104, and 106 are accurately marked on strobel 100.

Figure 2:
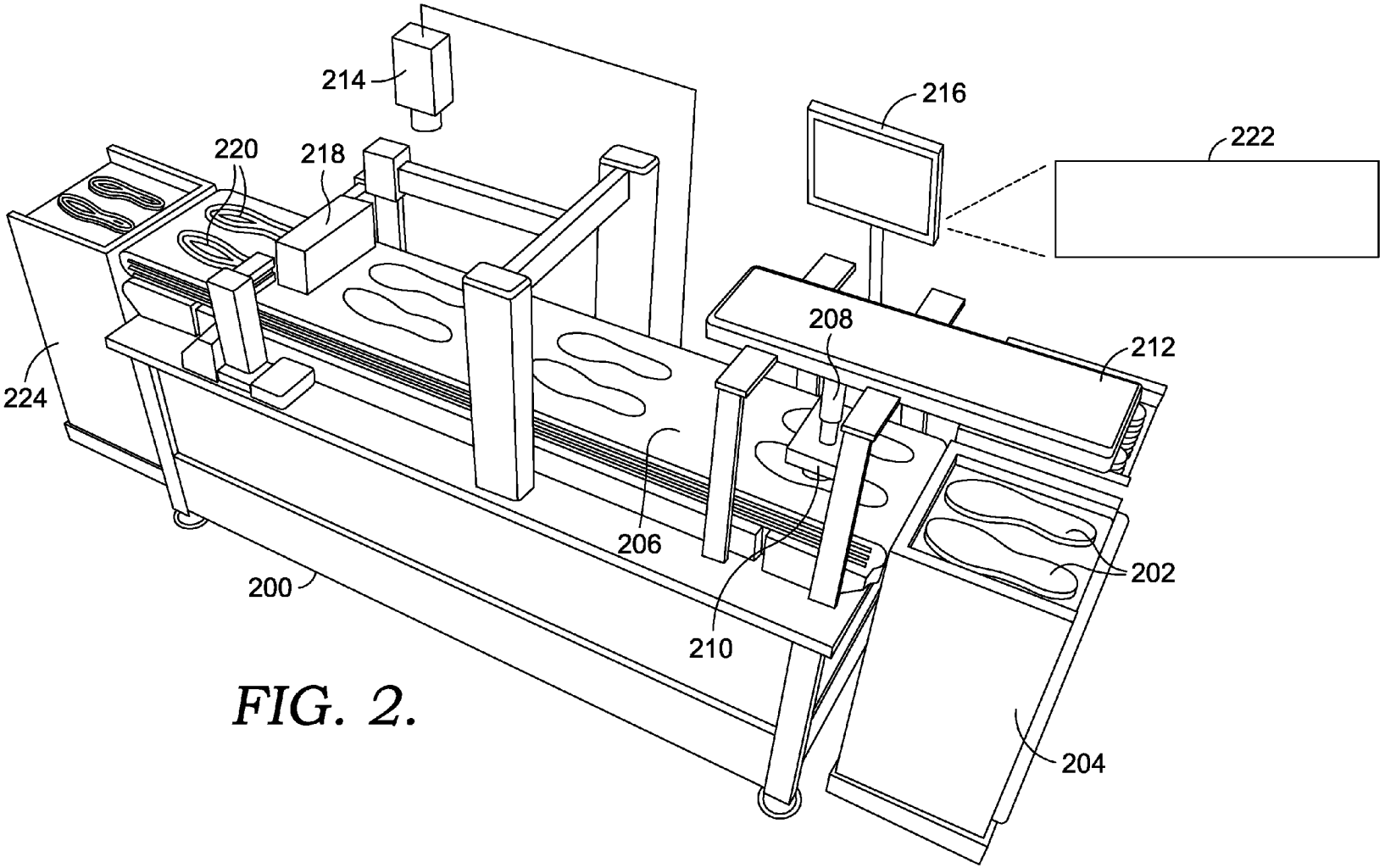
FIG. 2 is a diagram of an apparatus that automates the marking of guidelines on shoe strobels, according to one example of the present invention.

FIG. 2 is a diagram of a machine 200 that automates the marking of guidelines on shoe strobels, according to one example of the present invention. In operation, machine 200 moves strobels 202 from a loading area to an imaging area for capturing images of strobels 202, printing area for marking strobels 202 based on the images, and a removal area for placing strobels 202 in a finished compartment for the next phase of shoe manufacturing. In the example depicted in FIG. 2, strobels 202 are moved from the loading area to the imaging, printing, and removal areas by conveyor 206. The present invention is not limited, however, to using conveyors belts or devices to move strobels to and through imaging, printing, and/or removal areas. In fact, some examples moving strobels using different machines or devices, like robotic arms, ramps, moving platforms, or other ways to transfer assembly-line parts.

In the loading area, pre-cut strobels 202 are stacked on top of each other in loading compartment 204. Although not shown, loading compartment 204 may have wheels to easily be moved when empty of strobels 202. From loading compartment 204, strobels 202 are moved to conveyor 206 that guides strobels 202 through the vision and printing areas. Conveyor 206 may include a conveyor belt, drive train, motor, or other typical conveyor mechanism known to those skilled in the art. Also, conveyor 206 may continuously carry strobels 202 or intermittently stop so strobels 202 can be photographed and/or marked. In other words, conveyor may top when strobels reach a camera, printer, and/or the loading or removal areas, but need not stop.

Moving strobels 202 onto conveyor 206 may be accomplished in various ways. In one example, arm 208 affixed with vacuum pad 210 picks up strobels 202 from the stack of strobels 202 in loading compartment 204 using bursts of compressed air to vacuum grip strobels 202 to vacuum pad 210. The NF Series manufactured by the VMECA Group, headquartered in Seoul, Korea, represents one example of a vacuum pad 210 capable of vacuum gripping strobels 202. Arm 208 and vacuum pad 210 move along track 212, which overhangs loading compartment 204 and a portion of conveyor 206 for easy access to both. While not shown, track 212 may be equipped with a conveyor or electronic components for moving arm 208 and vacuum pad 210. In one embodiment, arm 208 and vacuum pad 210 simply move between two pre-determined spots on track 212: one for picking up strobels 202 and one or releasing strobels 202 onto conveyor 206.

Although different configurations of conveyor 206 have been described, it should be understood and appreciated that other types of suitable devices and/or machines that can move strobels 202 down to camera 214 and printer 218 may alternatively be used, and that the present invention is not limited to conveyor 206 described herein. For instance, examples of the present invention contemplate systems that are configured to carry articles of footwear in a nonlinear path or in multiple directions, respectively. So other embodiments of the present invention may use suspended movement to transfer strobels 202—as opposed to a vertically support conveyor—and also apply variable rates of movement. It should therefore be understood that the illustrated embodiments of conveyor 206, describe herein, are not meant to be limiting and may encompass any other suitable material-conveyance processes and accompanying devices known to those in the shoe-manufacturing industry.

Other examples of the present invention may move strobels 202 onto conveyor 206 in alternative ways. Strobels 202 may be pushed from loading compartment 204 to conveyor 206 instead of being picked up and put down. Loading compartment may be taller than conveyor 206 with an introduction ramp for strobels to be pushed from the top of loading compartment 204 and allowed to slide down the introduction ramp onto conveyor 206. Alternatively, loading compartment 204 may not be necessary because strobels 202 enter conveyor 206 from another shoe-manufacturing machine or process (e.g., device that cuts the strobels).

In one example, the conveyor 206 moves strobels 202 to an imaging area including a camera that captures images to be used to instruct a printer 216 how to mark guidelines on strobels 202. Camera 214 may be any type of photographic or video camera and may include light-sensitive chips, such as a charge coupled device ("CCD") or complementary metal oxide semiconductor ("CMOS") chip. In operation, camera 214 captures images of passing-by strobels 202, and the images are processed by computing device 216 to determine how strobels 202 are positioned. Positions of strobels 202 are analyzed by computing device 216 to determine how to accurately print guidelines, and guidelines for a particular shoe model and/or shoe size are then printed. For instance, computing device 216 may determine an area in passing strobel material for printing guidelines for a men's size 10 strobel for the popular Nike Shox® athletic shoe.

While shown in an overhanging position, camera 214 may be oriented differently depending on the type of camera. For example, multiple camera 214 may comprise multiple cameras: one for capturing color data and one for capturing depth data via infrared light or lasers. In one example, camera 214 may include a grid area of infrared light or lasers that can determine the position of strobels on conveyor 206. Numerous other types of cameras may also be used but need not be discussed at length herein.

Computing device 216 may be any type of locally connected or networked computer, server, or the like equipped with one or more processors and computer-storage memory (e.g., random access memory ("RAM"), read only memory ("ROM"), cache, or the like). Images may be sent to servers for processing and error checking, or just processed on a locally connected computing device (i.e., a "client" computing device). Computing device 216 may be equipped with an image-recognition module (not shown) implemented in software, hardware, firmware, or a combination thereof that identifies strobel 202 in a captured image using various techniques. The image-recognition module may compare color contrasts in an image to determine strobel 202 edges. Infrared depth data may be analyzed to determine which portions of the image were closer to camera 216, assuming strobel 202 is oriented atop conveyor 206 and thus closer to camera 216. The image-recognition module may search an image for strobel patterns or curvatures signifying the arcuate nature of strobel 202, or search for interconnected large and small bulbous areas signifying toe and heel regions of strobel 202. Reflective marks or piezoelectric materials may be added to strobel 202 and identified by the image-recognition module signifying strobel 202 or parts of strobel 202—like a perimeter or center. Recognition techniques are not limited to the aforementioned, as others may alternatively be used to identify strobel 202 in an image.

In the example illustrated, computing device 216 includes a personal computer ("PC") with a touch-screen panel. Workers can interact with the PC using the touch-screen panel. Some embodiments will display captured images of strobels 202 on the touch-screen panel, as well as different diagnostics for the marking process. Examples of diagnostics, while far too many to list, may include system performance (e.g., number of strobels 202 marked per day, hour, minute, or other span of time), toner levels of printer 218, viability of camera components for camera 214 (e.g., burnt-out lights, memory storage availability, etc.), results of error-checking, and network connectivity. In particular, error-checking results may be batched and communicated to computing device 216 to convey how many guidelines have been printed correctly or incorrectly during a particular time frame. For example, the results may notify a user that five percent of strobels are being marked outside of some quality standard (e.g., cross-sectional lines do not fit properly, guidelines are not spaced far enough apart, or the like). One skilled in the art will appreciate that batched results may be stored and computed by a backend network of one or more computers or servers.

In one example, conveyor 206 carries strobels 202 into a printing area that includes printer 218. In the printing area, computing device 216 uses the images captured by camera 214 and the objects recognized by image-recognition module to instruct printer 216 to mark guidelines 220 on strobels 202. In addition, cross-sectional lines may also be printed on strobels 202.

Afterwards, another round of images may be taken, in some examples, to error-check guidelines 220 and cross-sectional lines (if any). Error-checking may be performed to make sure guidelines 220 are being printed acceptably or within an error threshold. Acceptability may be checked by analyzing guidelines 220 for ink bleeding, ink rasterization, line symmetry and curvature, color, reflectiveness (when marks or piezoelectric materials are used), or where cross-sectional lines touch points or counter points. Additionally, an error threshold may be checked by ensuring lines are a threshold distance apart or within a threshold distance from a point or counter point. Images of guidelines 220 may compared with ideal images to ensure compliance with particular quality standards. For examples of the present invention that score or cut guidelines 220 instead of printing, acceptability and error-checking may be performed by capturing images of the sides of strobels 202 to make sure cutting reaches a certain depth (e.g., 0.1 mm). Other ways to check guidelines 220 for accuracy and errors may alternatively be used, even if not mentioned herein due to the large number of different scenarios that may be contemplated.

After guidelines 220 are added, strobels 202 proceed to the removal area where strobels 202 are placed into finished compartment 224 for the next phase of shoe manufacturing. Removing strobels 202 from conveyor 206 may be done in a number of ways. In one embodiment, a ramp may guide strobels 202 from conveyor 206 to finished compartment 224. Alternatively, a vacuum pad and arm—similar to vacuum pad 210 and arm 208—may pick up and place strobels 202 into finished compartment 224. Alternatively, machine 200 may not include finishing compartment, instead allowing conveyor 206 to carry strobels 202 to other phases of shoe manufacturing.

Figure 3:
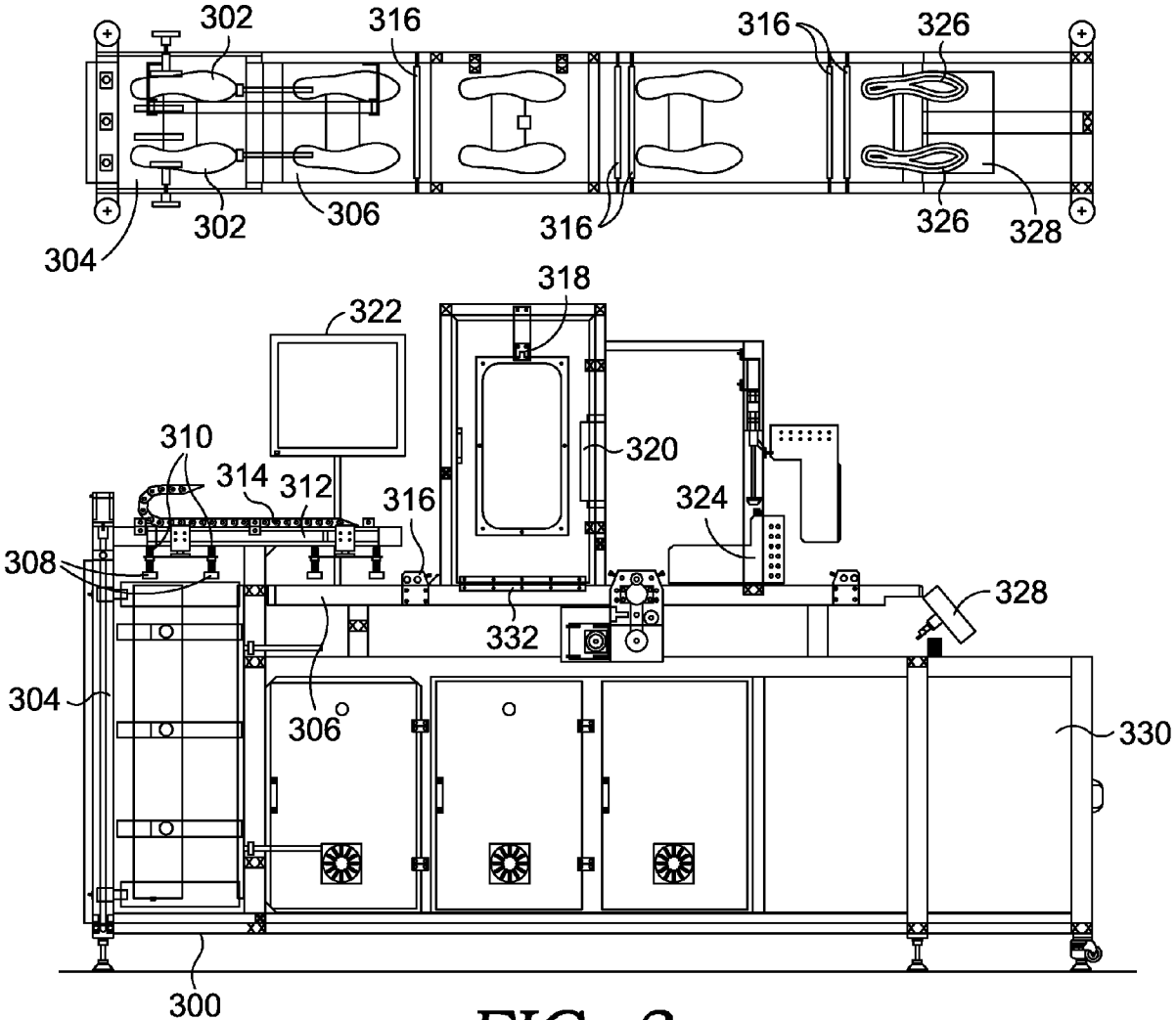
FIG. 3 is a diagram of multiple perspectives of a machine for marking guidelines on shoe strobels, according to one example of the present invention.

FIG. 3 is a diagram of multiple perspectives of an example of a machine 300 for marking guidelines on shoe strobels in accordance with the present invention. The top perspective shows a side view of machine 300. The bottom perspective shows a top view of conveyor 306 carrying strobels 302 from a loading area through an imaging area for image capturing, printing area for guideline marking, and removal area for removal from conveyor 306. Looking at the top perspective, loading compartment 304 houses a stack of strobels 302 yet to be marked with guidelines. Strobels 302 are moved from loading compartment 304 to conveyor 306 by vacuum pads 308 attached to arms 310 and moved down track 312. Conveyor 314 moves vacuum pads 308 and arms 310 down track 312, where strobels 302 are dropped onto conveyor 306. Once on conveyor 306, strobels pass underneath wire guide 316, which keeps strobels 302 flat on conveyor 306 before entering the imaging area for image capture. As illustrated in the bottom perspective, numerous wire guides 316 may be situated at different points on conveyor 306 ensure strobels 302 lie flat.

As previously mentioned, the present invention fully contemplates other machines or processes of conveying strobels 302 other than conveyor 306. It should be understood and appreciated that other types of suitable devices and/or machines can move strobels 302 to camera 318 and printer 324, and such devices may alternatively be used. Thus, the present invention is not limited to conveyor 306 described herein. For instance, embodiments contemplate systems configured to carry strobels 302 in a nonlinear path or in multiple directions. Other embodiments of the present invention may use suspended movement to transfer strobels 302—as opposed to a vertically support conveyor—and also apply variable rates of movement. It should therefore be understood that the illustrated embodiments of conveyor 306, describe herein, are not meant to be limiting and may encompass any other suitable material-conveyance processes and accompanying devices known to those in the shoe-manufacturing industry.

Different machines in accordance with the present invention may include different types of cameras. The top perspective depicts camera 318 as part of a vision housing 320 that closes on top of strobels 302. In other words, vision housing 320 is pivotally connected to machine 300 to allow vision housing 320 to descend and surround strobels 302. For example, when vision housing 320 is down camera 318 may capture images of strobels 302. As another example, camera 318 may scan along different axes to produce a scanned image of strobels 302. The present invention is therefore not limited to photographic images or video, but can use scans of strobels 302. To aid scanning, photographing, or videoing strobels 302, the present invention may use fluorescent light 320 to improve image, scan, or video quality.

For each strobel 302, computing device 322 analyzes captured images to ascertain the position of strobel 302 on conveyor 306. Any of the previously described image-recognition techniques may be used to locate strobels 302 in captured images. From images, computing device 322 can determine the position of the strobel 302 on conveyor 306 and use the position to instruct a communicatively connected printer 324 to mark guidelines on the strobel 302. Computing device 322 may also be configurable to print guidelines for different shoe models and sizes. Printer 324 may be a multi-head inkjet, dot-matrix, or laser printer with controller driven by computing device 322. Other examples of the present invention may use a device capable of cutting or scoring guidelines instead of printer 324, with computing device 322 controlling the device. Still other examples of the present invention apply piezoelectric plastics or piezoelectric marks to signify guidelines.

Different machines in accordance with the present invention may remove marked strobels 302 from conveyor 306 in different ways. Both perspective show ramp 328 at the end of conveyor 306 where strobels 306 slide down to finished compartment 330. Perhaps the simplest example allows marked strobels 302 to fall from conveyor directly into finished compartment 330; however, such a removal technique may complicate later shoe-manufacturing phases if strobels 302 are not neatly stacked. To neatly stack marked strobels in finished compartment 330, vacuum pads or robotic arms may remove marked strobels 302 from conveyor 306 and stack marked strobels 302 on top of each other in finished compartment 330. Finished compartment 330 may be equipped with wheels for easy removal from machine 300 when full.

Figure 4:
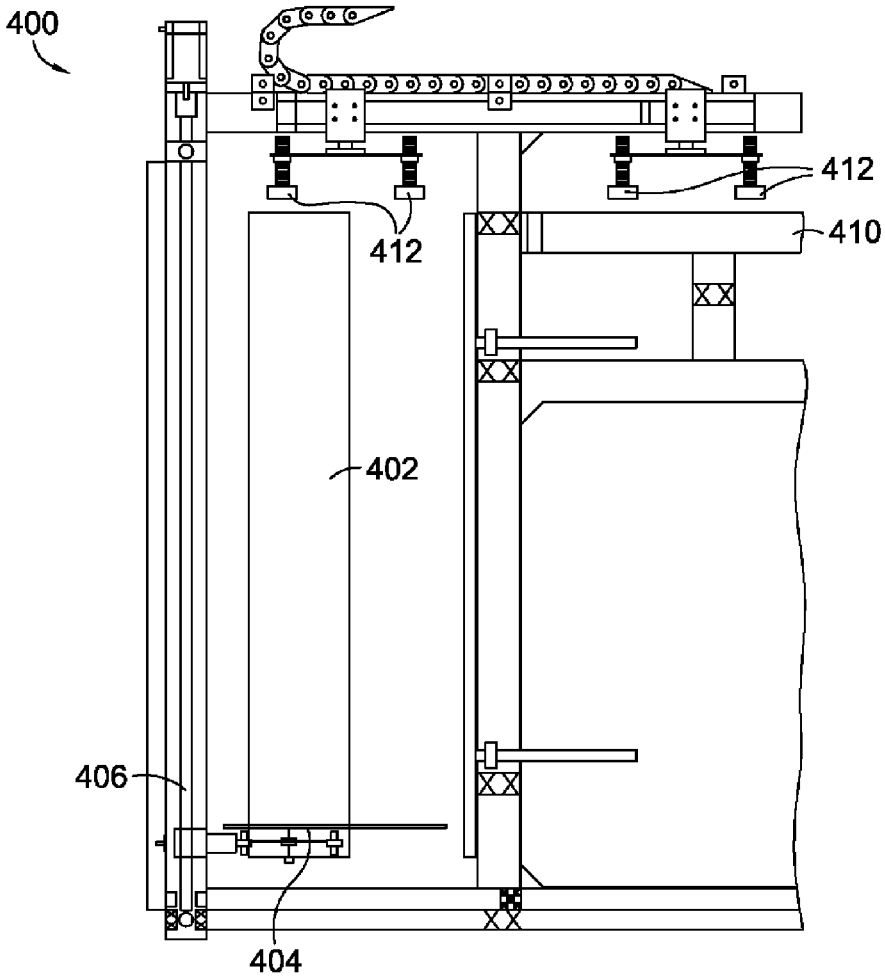
FIG. 4 is a diagram of a loading compartment, according to one example of the present invention.

FIG. 4 is a diagram of a loading compartment 400, according to one example. Block 402 represents a stacks of strobels that are yet to be marked with guidelines. The stacks include, in one embodiment, two separate stacks for a right and left foot strobels. Bottom plate 404 supports the stacks and is pressurized below (not shown) to move upwards, along track 406, in order to replace strobels after pairs vacuum gripped and placed on conveyor 410 by vacuum pads 412. To move upwards, bottom plate 404 may be pressurized with underneath springs—or other ways for applying pressure—to constantly push strobels upward. Once all strobels in the stacks are used, loading compartment 400 can either be refilled or replaced with a full loading compartment 400.

Again, the present invention is not limited to any particular structure for loading components onto a conveyor. Loading compartment 400 is illustrated purely for explanatory purposes. Some examples may not use a separate loading compartment to introduce strobels to the different devices mentioned herein, opting instead to just add such devices to already-existing shoe-manufacturing production lines.

Figure 5:
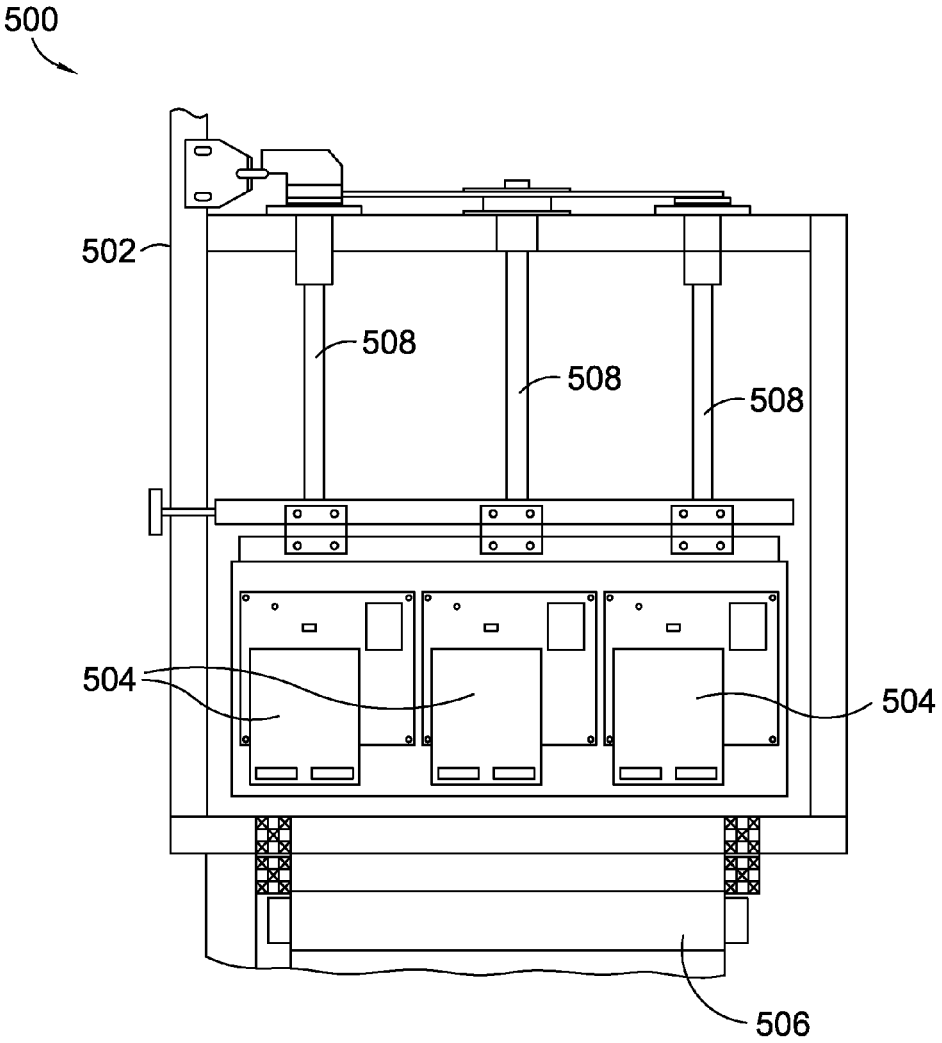
FIG. 5 is a diagram of a printer capable of printing guidelines onto strobels, according to one example of the present invention.

FIG. 5 is an exemplary diagram of a printer 500 capable of printing guidelines onto strobels in accordance with the present invention. Printer 500 may be communicatively connected to a computing device that instructs how to print guidelines on each strobel based on images captured of the strobel. Printer 500 includes a chassis 502 housing several printer heads 504 that are moved by arms 508. Arms 508 are, in turn, controlled by a controller (not shown), such as a microcontroller or processor. The computing device instructs printer 500 when to print and gives coordinates (e.g., x/y or three-dimensional coordinates) for printing, and the controller accordingly moves printer heads 504. In operation, strobels are brought underneath printer heads 504 by conveyor 506, and one or more captured images of the strobels are used to determine coordinates for printing.

Many different types of printers may be used. Examples include, without limitation, toner-based, inkjet, laser, solid ink, dye-sublimation, inkless, thermal, ultraviolet ("UV"), impact, dot-matrix printers or the like. Other examples of the present invention may not even use printers, opting instead to incise, score, apply reflective or piezoelectric marks, or otherwise designate guidelines on strobels. Combinations of such marking devices may also be used to apply guidelines.

Figure 6A:
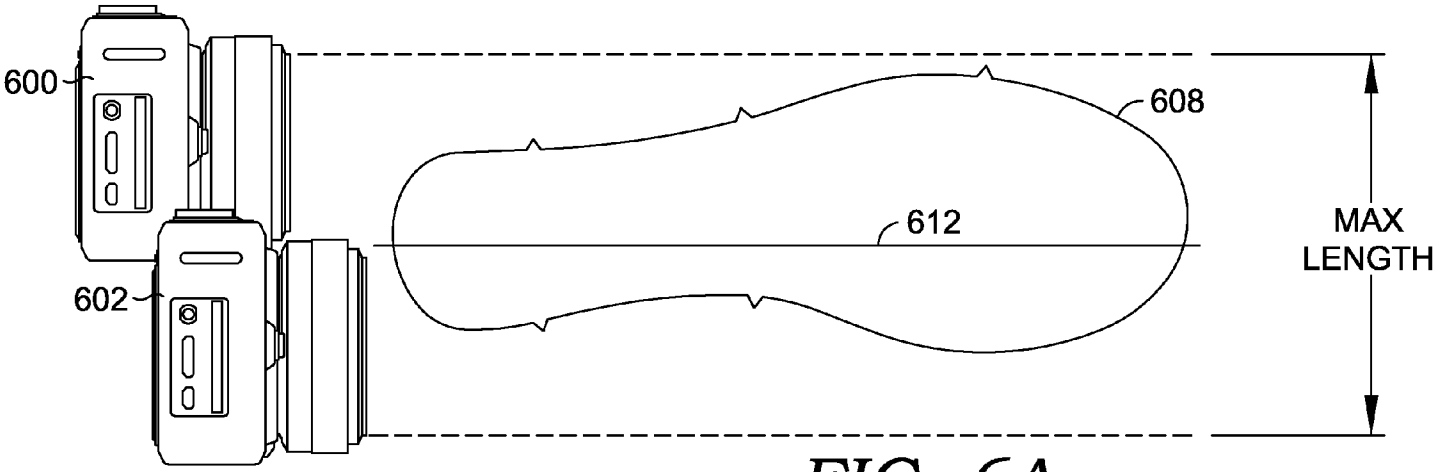
FIGS. 6A and 6B illustrate multiple printer heads being use to mark guidelines on strobels, according to one example of the present invention.
Figure 6B:
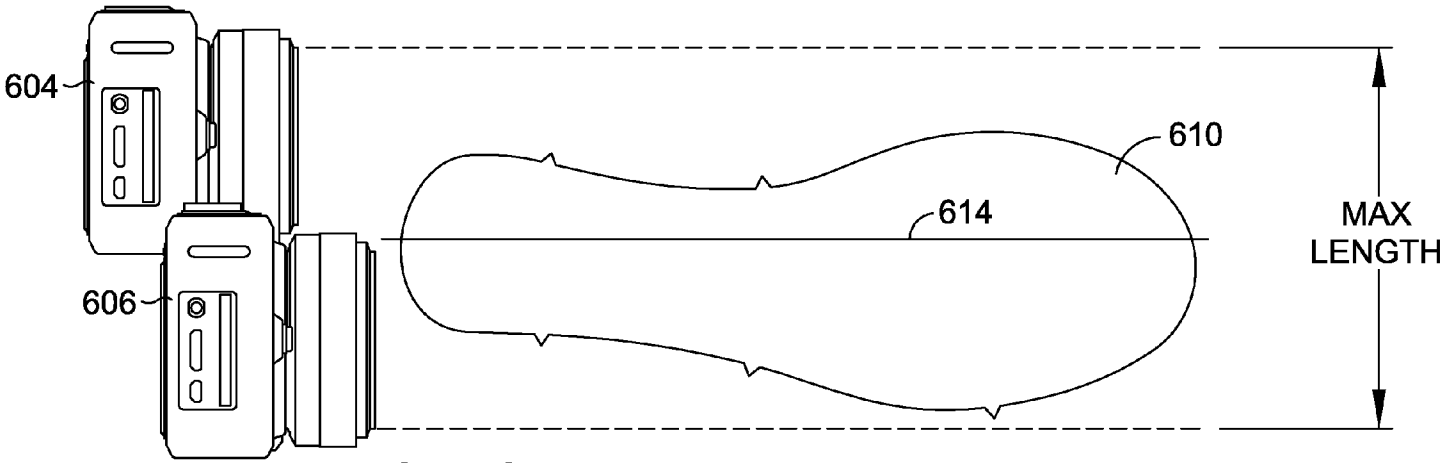

FIGS. 6A and 6B illustrate multiple printer heads 600-606 being use to print guidelines on strobels, according to one embodiment. Printer heads 600-606 represent four printer heads positioned in pairs to ideally print guidelines on left strobel 608 and right strobel 610 at or near the same time. In combination, each pair of printer heads together prints within a specific length, shown as lengths 616 and 618. Lines 612 and 614 represent boundaries over which each the printer heads print. One example instructs printer heads 600 and 604 to print above lines 612 and 614, respectively and printers heads 602 and 606 to print below lines 612 and 614, respectively. Printer heads 602 and 606 may be included in the printers mentioned herein or in other types of printers that can be used to mark guidelines on strobels.

Figure 7:
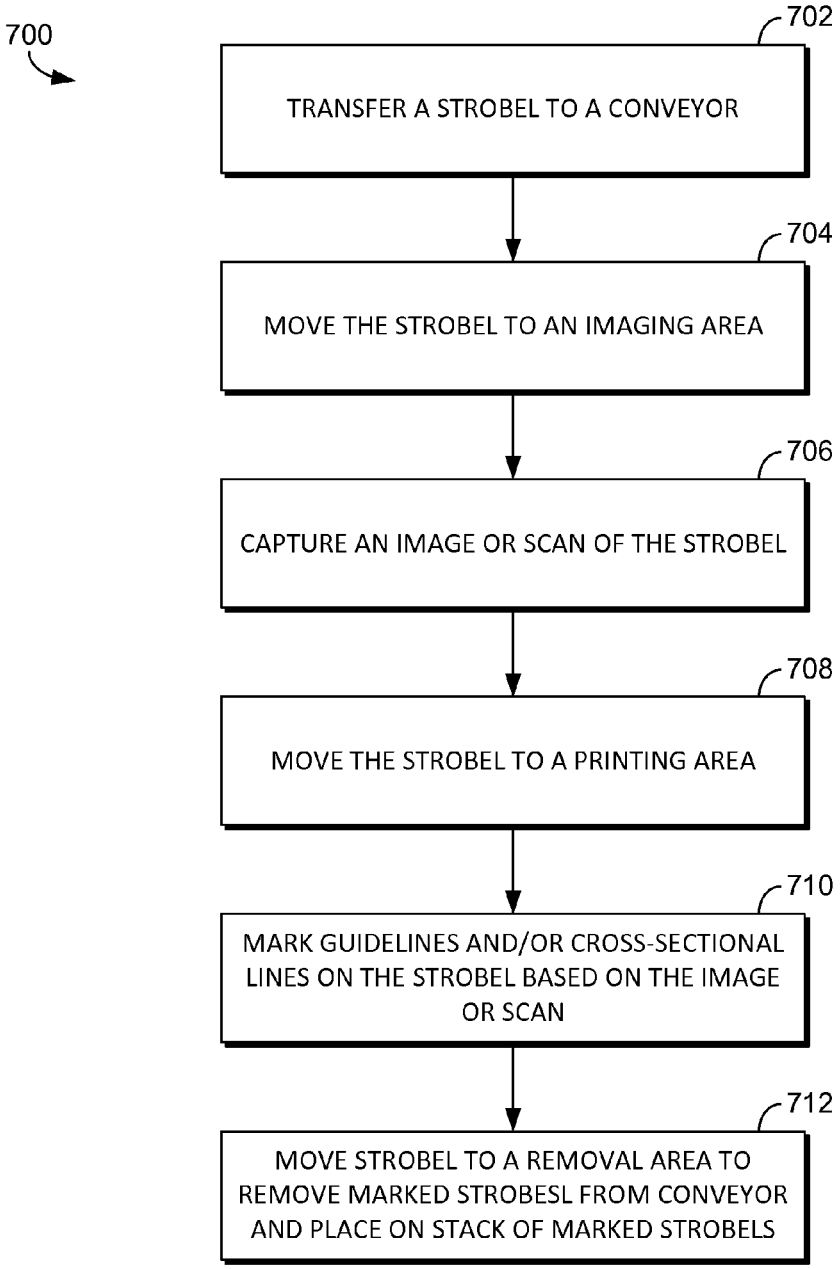
FIG. 7 is a diagram of a process flow for marking guidelines on strobels, according to one example of the present invention.

FIG. 7 is a diagram of a process flow 700 for marking guidelines on strobels, according to one example of the present invention. As illustrated at 702, a vacuum pad vacuum grips and transfers a strobel from a stack to a conveyor. The conveyor moves the strobel to an imaging area, as shown at 704. In the imaging area, a camera or scanner captures an image or scan of the strobel, as shown at 706. The conveyor then moves the strobel to a printing area, as shown at 708. When the strobels are in the printing area, a computing device instructs a printer to mark (e.g., through printing, sewing, adding piezoelectric or other marks, or the like) guidelines and/or cross-sectional lines on the strobel based on the image, as shown at 710. Once guidelines and/or cross-sectional lines are marked on the strobel, the conveyor moves the strobel to a removal area where the strobel is removed from the conveyor (e.g., through vacuum gripping, via a ramp, or some other mechanism for removing the strobel) and transferred onto a stack of marked strobels, as shown at 712. It should be noted that FIG. 7 merely depicts one example of the present invention. Other examples may include alternative or additional steps to mark strobels.

The present invention has been described in relation to particular embodiments, which are intended in all respects to illustrate rather than restrict. Alternative embodiments will become apparent to those skilled in the art that do not depart from its scope. Many alternative embodiments exist, but are not included because of the nature of this invention.

Although the subject matter has been described in language specific to structural features and methodological acts, it is to be understood that the subject matter defined in the appended claims is not necessarily limited to the specific features or acts described above. Instead, the specific features and acts described above are disclosed as example forms of implementing the claims.

The invention claimed is:

1. A system for marking a strobel, comprising:

a loading area for introducing the strobel onto a conveyor;

a camera for capturing an image of the strobel when the strobel is moved by the conveyor to an imaging area;

a printer for printing guidelines for particular a shoe model on the strobel when the conveyor moves the strobel from the imaging area to a printing area, wherein the guidelines comprise lines, printed by the printer, that are between 0.4 mm and 1.1 mm thick; and a computing device for determining a position of the strobel from the image, and based on the position, instructing the printer where to print the guidelines for the particular shoe model on the strobel.

2. The system of claim 1, further comprising a vacuum pad for removing the strobel from the conveyor after being marked with the guidelines.

3. The system of claim 2, wherein the vacuum pad uses compressed air to vacuum grip the strobel.

4. The system of claim 1, further comprising a vacuum for removing the strobel from a stack of strobels in the loading area and placing the strobel on the conveyor.

5. The system of claim 1, further comprising a second conveyor capable of moving the strobel to a finished compartment comprising a stack of strobels marked with guidelines.

6. The system of claim 1, wherein the strobel is a shoe strobel.

7. The system of claim 1, wherein the camera comprises a charge coupled device ("CCD") camera that includes a light-sensitive chip for image gathering.

8. The system of claim 1, wherein the printer comprises an inkjet printer.

9. The system of claim 1, wherein the printer comprises a laser printer.

10. The system of claim 1, further comprising an image recognition module that analyzes the image and recognizes the strobel in the images.

11. The system of claim 1, wherein the printer uses piezoelectric materials to print the guidelines on the strobel.

12. The system of claim 1, further comprising:

a wire guide for guiding the strobel into the imaging area; and a roller for keeping the strobel from lifting off of the conveyor.

13. A system for marking a shoe strobel, comprising:

a loading device that transfers the shoe strobel from a first compartment onto a conveyor; and a camera that captures one or more images of the shoe strobel when the shoe strobel is moved by the conveyor from the loading device to an imaging area;

an image recognition module on a computing device that recognizes a position of the shoe strobel on the conveyor when the conveyor moves the shoe strobel to the imaging area; and a printer, controlled by the computing device, that prints guidelines on the shoe strobel based on the one or more images when the conveyor moves the shoe strobel from the imaging area into a printing area.

14. The system of claim 13, further comprising a ramp allowing the shoe strobel, after being marked with the guidelines, to transfer from the conveyor to a second compartment.

15. The system of claim 13, wherein the compartment comprises a stack of a plurality of shoe strobels.

16. The system of claim 13, wherein the first and second compartments comprise stacks of shoe strobels.

17. The system of claim 13, wherein the loading device comprises:

a vacuum pad affixed to an arm through which compressed air is blown; and a controller, instructed by the computing device, for moving the arm and determining when to blow the compressed air.

18. A process for marking guidelines on a shoe strobel, comprising:

using a vacuum pad to vacuum grip the shoe strobel to transfer the shoe strobel from a stack of shoe strobels to a conveyor;

using the conveyor, moving the shoe strobel to an imaging area;

in the imaging area, capturing an image of the shoe strobel;

using the conveyor, moving the shoe strobel from the imaging area to a printing area;

in the printing area, printing guidelines on the shoe strobel based on the image;

checking the guidelines for compliance with one or more error thresholds for guideline printing;

removing the shoe strobel from the conveyor because the guidelines printed on the shoe strobel exceeded at least one of the one or more error thresholds; and from the printing area, moving the shoe strobel with the guidelines to a removal area where the strobel is transferred onto a stack of completed shoe strobels because the guidelines printed on the shoe strobel were in compliance with one or more error thresholds.

* * * * *